US006608454B2

(12) United States Patent
Shimizu et al.

(10) Patent No.: US 6,608,454 B2
(45) Date of Patent: Aug. 19, 2003

(54) COLOR CATHODE RAY TUBE

(75) Inventors: Norio Shimizu, Fukaya (JP); Takuya Mashimo, Kumagaya (JP); Masatsugu Inoue, Kumagaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/009,775

(22) PCT Filed: Apr. 16, 2001

(86) PCT No.: PCT/JP01/03244

§ 371 (c)(1),
(2), (4) Date: Dec. 17, 2001

(87) PCT Pub. No.: WO01/80277

PCT Pub. Date: Oct. 25, 2001

(65) Prior Publication Data

US 2003/0016307 A1 Jan. 23, 2003

(30) Foreign Application Priority Data

Apr. 17, 2001 (JP) ..... 2000-115152

(51) Int. Cl.[7] ..... G09G 1/04

(52) U.S. Cl. ..... 315/366; 313/408; 313/477 R; 313/461

(58) Field of Search ..... 315/375–377, 315/366; 313/408, 461, 477 R, 495

(56) References Cited

U.S. PATENT DOCUMENTS 4,881,004 A * 11/1989 Inoue et al. ..... 313/408
5,495,140 A * 2/1996 Fujiwara et al. ..... 313/477 R
5,663,610 A * 9/1997 Inoue et al. ..... 313/461

FOREIGN PATENT DOCUMENTS

| | | |
|---|---|---|
| EP | 0 612 094 | 8/1994 |
| EP | 0 923 107 | 6/1999 |

* cited by examiner

*Primary Examiner*—Don Wong
*Assistant Examiner*—Wilson Lee
(74) *Attorney, Agent, or Firm*—Oblon, Spivak, McClelland, Maier & Neustadt, P.C.

(57) ABSTRACT

An inner surface of the panel is formed to satisfy at least one of the following relationships: ZPH/LPH≦0.0050, and ZPV/LPV≦0.050 where LPH represents a distance from a center of the effective section to a long axis end of the effective section. LPV represents a distance from the center to a short axis end of the effective section, ZPH represents a fall of the effective section at the long axis end along the tube axis, and ZPV presents a fall of the effective section at the short axis end along the axis of the tube axis. At least one of each long side and each short side of a mask surface is curved such that a central portion thereof projects outwardly, and satisfies at least corresponding one of the following relationships: YML/LML≦0.015, and XMS/LMS≦0.015 where LML represents a distance from the short axis to each corner of an effective portion of the mask surface, LMS represents a distance from the long axis to each corner of the effective portion, YML represents a fall, along the short axis, between a point of each long side on the short axis and a corner of the long side, and XMS represents a fall, along the long axis, between a point of each short side on the long axis and a corner of the short side.

5 Claims, 7 Drawing Sheets

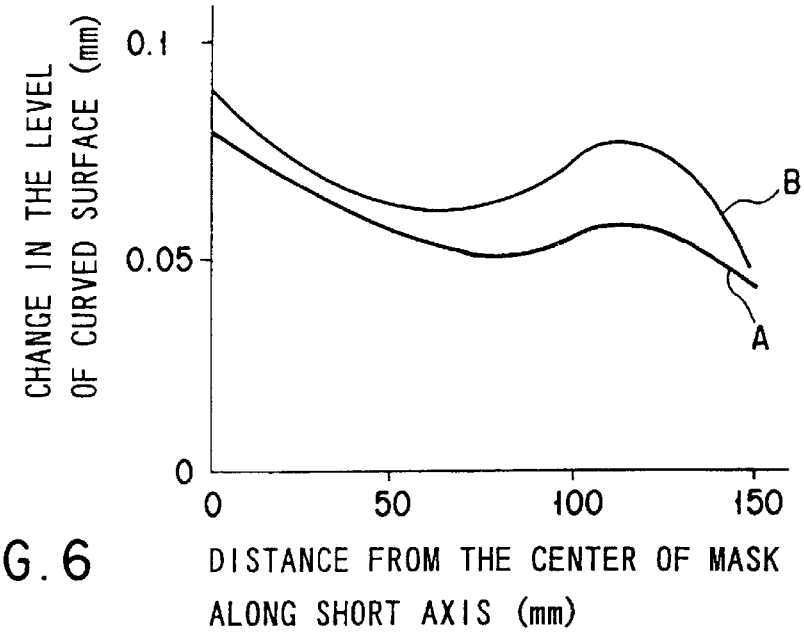
FIG. 6
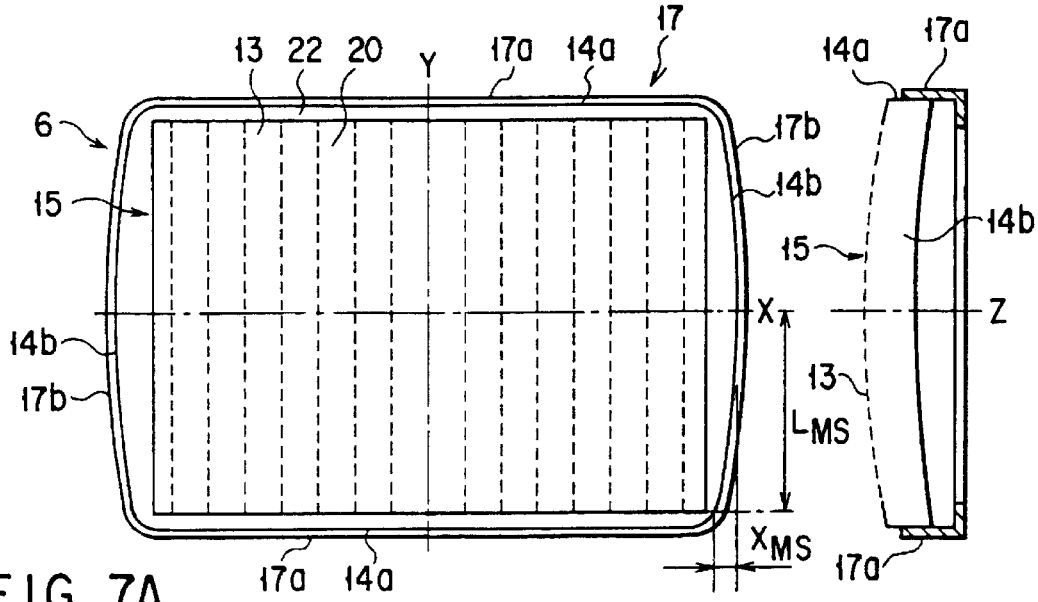
FIG. 7A
FIG. 7C
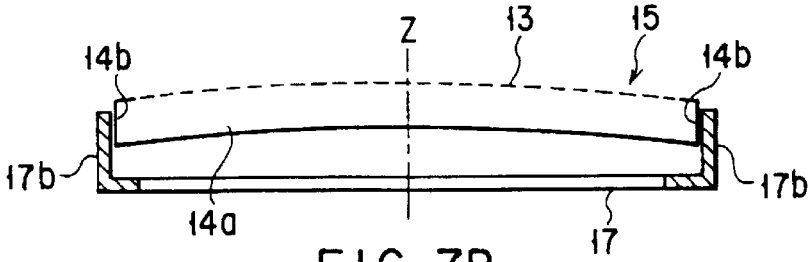
FIG. 7B

COLOR CATHODE RAY TUBE

TECHNICAL FIELD

The present invention relates to a color cathode ray tube that incorporates a panel with a substantially flat outer surface, and a shadow mask.

BACKGROUND ART

In general, a color cathode ray tube includes a vacuum envelope having a substantially rectangular panel and a funnel. The panel has an effective section formed of a curved surface, and a skirt section standing from the periphery of the effective section. The funnel is jointed to the skirt section. On the inner surface of the panel effective section is provided a phosphor screen, which has non-emission black substance layers and three-color phosphor layers that are provided between the black substance layers and emit blue, green and red light. A substantially rectangular shadow mask is arranged inside the panel and opposed to the phosphor screen with a predetermined gap therebetween.

In the neck of the funnel, an electron gun is provided for emitting three electron beams. In the color cathode ray tube, three electron beams emitted from the electron gun are deflected by a magnetic field generated from a deflection yoke that is mounted on an outer surface of the funnel, thereby horizontally and vertically scanning the phosphor screen via the shadow mask to display a color image.

The shadow mask includes a mask main body, which has a substantially rectangular effective surface and a skirt portion extending from the periphery of the effective surface, and a rectangular mask frame fixed to the skirt portion of the mask main body. A large number of electron beam passage apertures are formed in the effective surface of the mask main body. These electron beam passage apertures cause the three electron beams, emitted from the electron gun, to reach selected portions of the three-color phosphor layer. The shadow mask is supported inside the panel by engaging, for example, holders attached to the corner sections of the mask frame, with stud pins provided on the corners of the skirt section of the panel.

In the above-described color cathode ray tube, in order to display a color image without color drift on the phosphor screen, it is necessary to accurately land, on the target three-color phosphor layers, the three electron beams passing through the electron beam passage apertures of the shadow mask. To this end, it is necessary to appropriately keep the distance (q value) between the inner surface of the panel effective section and the effective surface of the mask main body.

In recent years, a color cathode ray tube is being put to practice, in which the outer surface of the panel effective section is made to have a low curvature and therefore to be almost flat so as to enhance the visibility of display. In this color cathode ray tube, the greater the curvature of the inner surface of the panel effective section, the larger the difference in thickness between a central portion and a peripheral portion of the effective section. This is disadvantageous in light of display visibility. To avoid this, it is necessary to reduce the curvature of the inner surface of the panel effective section in accordance with the shape of the outer surface of the panel effective section. Further, in order to secure a "q" value appropriate for realizing appropriate beam landing, it is also necessary to reduce the curvature of the effective surface of the mask main body, opposed to the phosphor screen, in accordance with the shape of the inner surface of the panel effective section.

However, if the curvature of the effective surface of the mask main body is reduced, the mechanical strength of the mask main body is reduced, which means that the shadow mask will easily be deformed in the manufacturing process of the color cathode ray tube. Moreover, even after the color cathode ray tube is completed, the shadow mask will easily be deformed by an impact or a vibration applied thereto while it is transported. Also, when the color cathode ray tube is installed in a television set, it is possible that the shadow mask vibrates sympathetically with a sound emitted from a speaker, and hence the color purity of the image will degrade.

On the other hand, if the curvature of the effective surface of the main mask body is increased so as to avoid a reduction in its mechanical strength, it is necessary to increase the curvature of the panel effective section accordingly. In this case, the viewing angle is inappropriate, a displayed image is deformed, and a reflection image is easily formed on the inner surface of the effective section, thereby degrading the visibility of display. Furthermore, the brightness of a peripheral portion of the screen is reduced, thereby degrading the uniformity of a displayed image.

DISCLOSURE OF INVENTION

The present invention has been developed in light of the above-mentioned circumstances, and its object is to provide a color cathode ray tube, in which its shadow mask has a sufficient mechanical strength and which is improved in display visibility.

To obtain the above object, according to an aspect of the invention, there is provided a color cathode ray tube comprising: a vacuum envelope including a substantially rectangular panel having a substantially flat outer surface, an inner surface provided with a phosphor screen, and a long axis and a short axis perpendicular to each other and also to a tube axis; a shadow mask arranged in the vacuum envelope and opposed to the phosphor screen, the shadow mask including a mask main body that has a substantially rectangular mask surface and a skirt portion extending along a periphery of the mask surface, and a substantially rectangular mask frame attached to the skirt section of the mask main body, the mask surface including an effective portion opposed to the phosphor screen and provided with a plurality of electron beam passage apertures; and an electron gun provided in the vacuum envelope for emitting electron beams onto the phosphor screen through the shadow mask.

the inner surface of the panel has an effective section with a curvature, the inner surface of the panel being formed to satisfy at least one of the following relationships:

$$ZPH/LPH \leqq 0.050,$$

and $$ZPV/LPV \leqq 0.050$$

where LPH represents a distance from a center of the effective section to a long axis end of the effective section, LPV represents a distance from the center of the effective section to a short axis end of the effective section, ZPH represents a fall of the effective section at the long axis end along the tube axis with respect to a level of the center of the effective section, and ZPV presents a fall of the effective section at the short axis end along the tube axis with respect to the level of the center of the effective section.

The mask surface has a pair of long sides situated symmetrical with respect to the long axis, and a pair of short sides situated symmetrical with respect to the short axis, at least one of each long side and each short side being curved such that a central portion thereof projects outwardly, and satisfying at least corresponding one of the following relationships:

$$YML/LML \leqq 0.015,$$

and $$XMS/LMS \leqq 0.015$$

where LML represents a distance from the short axis of the effective portion of the mask surface to each corner of the effective portion, LMS represents a distance from the long axis of the effective portion of the mask surface to each corner of the effective portion, YML represents a fall, along the short axis, between a point of each long side of the mask surface on the short axis and a point of the each long side which is apart from the short axis by LML, and XMS represents a fall, along the long axis, between a point of each short side of the mask surface on the long axis and a point of the each short side which is apart from the long axis by LMS.

According to another aspect of the invention, there is provided a color cathode ray tube comprising: a vacuum envelope including a substantially rectangular panel having a substantially flat outer surface, an inner surface provided with a phosphor screen, and a long axis and a short axis perpendicular to each other and also to a tube axis; a shadow mask arranged in the vacuum envelope and opposed to the phosphor screen, the shadow mask including a mask main body that has a substantially rectangular mask surface and a skirt portion extending along a periphery of the mask surface, and a substantially rectangular mask frame attached to the skirt section of the mask main body, the mask surface including an effective portion opposed to the phosphor screen and provided with a plurality of electron beam passage apertures; and an electron gun provided in the vacuum envelope for emitting electron beams onto the phosphor screen through the shadow mask.

The inner surface of the panel has an effective section with a curvature, the inner surface of the panel being formed to satisfy at least one of the following relationships:

$$ZPH/LPH \leqq 0.050,$$

and $$ZPV/LPV \leqq 0.050$$

where LPH represents a distance from a center of the effective section to a long axis end of the effective section, LPV represents a distance from the center of the effective section to a short axis end of the effective section, ZPH represents a fall of the effective section at the long axis end along the tube axis with respect to a level of the center of the effective section, and ZPV presents a fall of the effective section at the short axis end along the tube axis with respect to the level of the center of the effective section.

The mask frame has a pair of long side walls situated symmetrical with respect to the long axis, and a pair of short side walls situated symmetrical with respect to the short axis, at least one of each long side wall and each short side wall having a convex curved shape such that a central portion thereof projects outwardly, and satisfying at least corresponding one of the following relationships:

$$YFL/LFL \leqq 0.015,$$

and $$XFS/LFS \leqq 0.015$$

where LFL represents a distance from the short axis of the effective section of the mask surface to each corner of the effective section, LFS represents a distance from the long axis of the effective section of the mask surface to each corner of the effective section, YFL represents a fall, along the short axis, between a point of each long side wall of the mask frame on the short axis and a point of the each long side wall which is apart from the short axis by LFL, and XFS represents a fall, along the long axis, between a point of each short side wall of the mask frame on the long axis and a point of the each short side wall which is apart from the long axis by LFS.

Preferably, the panel has a transmittance of 40 to 60% at the center of the effective section, and is formed to satisfy $Td/Tc<2.5$ where Tc represents a thickness of the center of the effective section, and Td represents a thickness of the panel at an effective length end of the phosphor screen.

Even if, in the color cathode ray tube constructed as above, the curvature of the outer surface of the effective section of the panel is reduced to make the outer surface almost flat, thereby reducing the curvature of the effective surface of the mask main body, the deformation of the mask main body due to an impact or vibration applied thereto during its manufacture or transport, and resonance between a sound emitted from a speaker and the mask main body when it is installed in a television set, are minimized, and the degradation of color purity due to miss landing of electron beams is reduced, thereby realizing a high display visibility.

BRIEF DESCRIPTION OF DRAWINGS

FIG. 6 is a graph illustrating the relationship between a distance from the center of the shadow mask along the short axis Y and a change in the level of the mask surface, obtained when the same load is applied to the mask main body of the conventional shadow mask and the shadow mask of the embodiment;

FIG. 7A is a plan view illustrating a shadow mask in a color cathode ray tube according to a second embodiment of the invention;

FIG. 7B is a sectional view taking along the long axis X of the shadow mask;

FIG. 7C is a sectional view taking along the short axis Y of the shadow mask;

BEST MODE FOR CARRYING OUT THE INVENTION

Color cathode ray tubes according to the embodiments of the present invention will be described with reference to the accompanying drawings.

Figure 1:
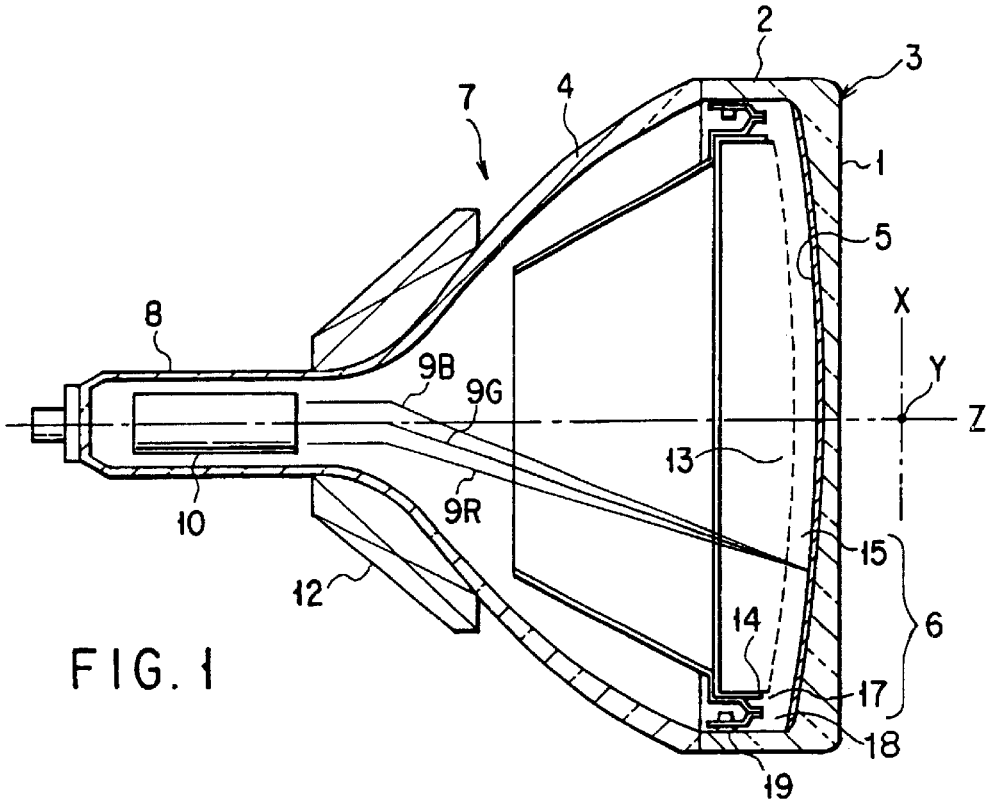
FIG. 1 is a sectional view illustrating a color cathode ray tube according to a first embodiment of the invention.

As shown in FIG. 1, a color cathode ray tube has a vacuum envelope 7 that includes a panel 3 and a funnel 4. The panel 3 has a substantially rectangular effective section 1 and a skirt section 2 standing from the periphery of the effective section. The effective section 1 has an outer surface formed of a flat surface or a curved surface with a low curvature, and an inner surface with a certain curvature described later. The funnel 4 is jointed to the skirt section 2. A phosphor screen 5, which has non-emission-black substance layers and three-color phosphor layers that are formed between the black substance layers and light up in blue, green and red, is formed on the inner surface of the effective section 1 of the panel 3. A substantially rectangular shadow mask 6 is arranged inside the panel 3 and opposed to the phosphor screen 5 with a predetermined distance therebetween.

The panel 3 and the shadow mask 6 have a long axis X (horizontal axis) perpendicular to the tube axis Z, and a short axis (vertical axis) perpendicular to the tube axis Z and the long axis X.

In the neck 8 of the funnel 4, an electron gun 10 is provided for emitting three electron beams 9B, 9G and 9R. In this color cathode ray tube, three electron beams 9B, 9G and 9R emitted from the electron gun 10 are deflected by a magnetic field generated from a deflection yoke 12 that is mounted on an outer surface of the funnel 4, thereby horizontally and vertically scanning the phosphor screen 5 via the shadow mask 6 to display a color image.

Figure 2:
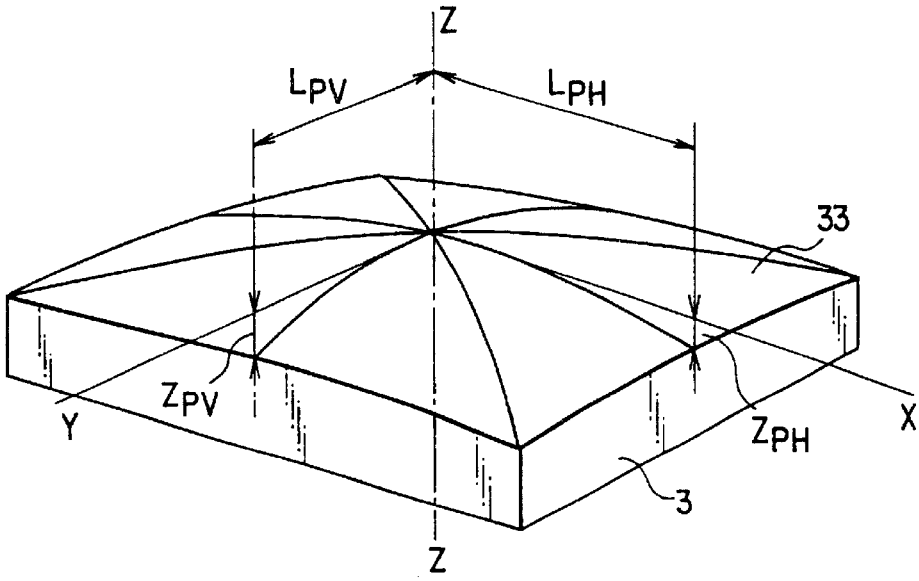
FIG. 2 is a perspective view schematically illustrating the shape of the inner surface of a panel in the color cathode ray tube.
Figure 3A:
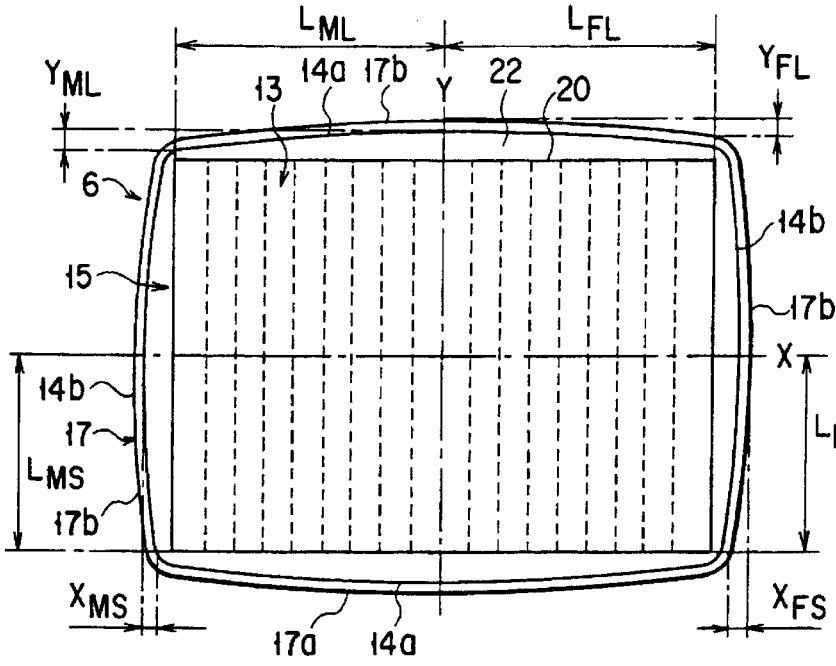
FIG. 3A is a plan view illustrating a shadow mask in the color cathode ray tube.
Figure 3C:
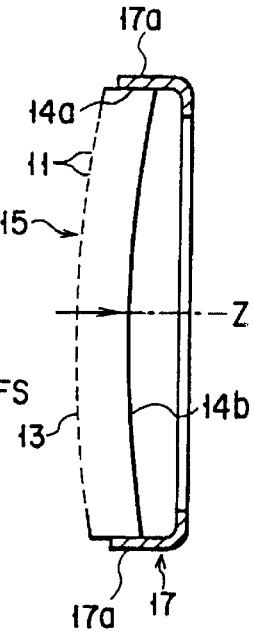
FIG. 3C is a sectional view taking along the short axis Y of the shadow mask.
Figure 3B:
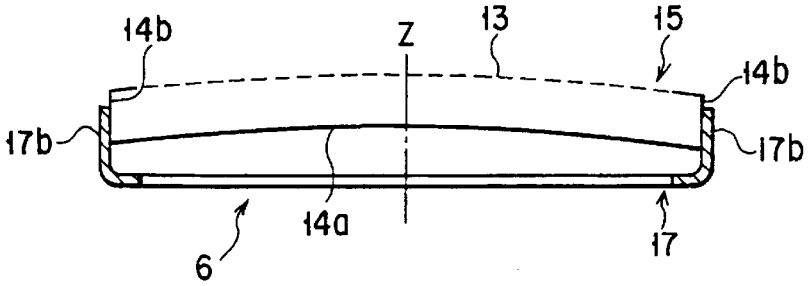
FIG. 3B is a sectional view taking along the long axis X of the shadow mask.

As shown in FIG. 2, in this embodiment, the inner surface 33 of the effective section 1 of the panel 3 has a curvature. Suppose that the distance between the center and an end of the effective section along the long axis X, and that between the center and an end of the effective section along the short axis Y are LPH and LPV, respectively. Further, suppose that a fall between the center and the X-directional end of the effective section along the tube axis Z, and that between the center and the Y-directional end of the effective section along the tube axis Z are ZPH and ZPV, respectively. In this case, the inner surface is formed to satisfy at least one of the following relationships:

$$ZPH/LPH \leqq 0.050$$

and $$ZPV/LPV \leqq 0.050.$$

Preferably, the panel 3 is formed to satisfy the following relationship:

$$Td/Tc < 2.5$$

wherein the transmittance of the center of the effective section 1 of the panel 3 is 40 to 60%, Tc is the thickness of the center of the effective section 1, and Td is the thickness of the effective section at an effective length end of the phosphor screen 5.

As shown in FIGS. 1 and 3A to 3C, the shadow mask 6 includes a mask main body 15 and a rectangular mask frame 17 provided on a peripheral portion of the mask main body 15. The mask main body 15 has a mask surface 13 and a skirt portion 14 extending along the periphery of the mask surface 13. The mask surface 13 includes a substantially rectangular effective portion 20 having a large number of electron beam passage apertures 11 formed therein, and an imperforate portion 22 located around the effective portion 20. The mask surface 13 is opposed to the phosphor screen 5 and has a curvature corresponding to the inner surface of the effective section 1 of the panel 3. The electron beam passage apertures 11 cause the three electron beams 9B, 9G and 9R, emitted from the electron gun 10, to reach selected portions of the three-color phosphor layers. The mask frame 17 is substantially rectangular, and fixed to the skirt portion 14 of the mask main body 15.

The shadow mask 6 is supported inside the panel 3 by engaging, for example, elastic support members 18 attached to the mask frame 17, with stud pins 19 provided on the corners of the skirt section 2 of the panel 3.

The mask surface 13 of the mask main body 15 has a pair of long sides located symmetrically with respect to the long axis X, and a pair of short sides located symmetrically with respect to the short axis Y. Similarly, the skirt portion 14 has a pair of long side walls 14*a* extending along the respective long sides of the mask surface 13, and a pair of short side walls 14*b* extending along the respective short sides of the mask surface 13. Further, the mask frame 17 has a pair of long side walls 17*a* located outside the respective long side walls 14*a* of the skirt portion 14, and a pair of short side walls 17*b* located outside the respective short side walls 14*b* of the skirt portion 14.

In this embodiment, the pair of long sides of the mask surface 13, the pair of long side walls 14*a* of the skirt portion 14 and the pair of long side walls 17*a* of the mask frame 17 are curved such that their respective central portions project outwardly. Similarly, the pair of short sides of the mask surface 13, the pair of short side walls 14*b* and the pair of short side walls 17*b* of the mask frame 17 are curved such that their respective central portions outwardly project.

More specifically, the long sides of the mask surface 13 and the long side walls 14*a* of the skirt portion 14 are curved from their respective points on the short axis Y to their respective corners, to have a convex curved shape which satisfies the following relationship:

$$YML/LML \leqq 0.015$$

where LML represents a distance from the short axis Y to each corner of the effective portion 20, and YML represents a Y-directional fall between the respective points of the long sides of the mask surface 13 and the long walls 14*a* of the skirt portion 14 on the short axis Y and the respective corners. Similarly, the short sides of the mask surface 13 and the short side walls 14*b* of the skirt portion 14 are curved from their respective points on the long axis X to their respective corners, to have a convex curved shape which satisfies the following relationship:

$$XMS/LMS \leqq 0.015$$

where LMS represents a distance from the long axis Y to each corner of the effective portion 20, and XMS represents an X-directional fall between the respective points the short sides of the mask surface 13 and the short side walls 14*b* of the skirt portion 14 on the long axis X and the respective corners.

Further, the long side walls 17*a* of the mask frame 17 is curved from a point on the short axis Y to each corner, to have a convex curved shape which satisfies the following relationship:

$$YFL/LFL \leqq 0.015$$

where LFL represents a distance from the short axis Y to each corner of the effective portion 20, and YFL represents a Y-directional fall between the point of the long side walls 17*a* on the short axis Y and each corner. Similarly, the short side walls 17*b* of the mask frame 17 is curved from a point on the long axis X to each corner, to have a convex curved shape which satisfies the following relationship:

$$XFS/LFS \leqq 0.015$$

where LFS represents a distance from the long axis Y to each corner of the effective section 20, and XFS represents an X-directional fall between the point of the short side wall 17*b* on the long axis X and each corner.

In the color cathode ray tube including the panel 3 and the shadow mask 6 constructed as above, the curvature of the outer surface of the effective section 1 of the panel 3 is reduced to make it as flat as possible, so as to enhance the visibility of display. Although the inner surface of the effective section 1 and the mask surface 13 of the shadow mask 6 are made to have low curvatures, the mask main body 15 is prevented from being deformed by an impact or a vibration applied thereto while the color cathode ray tube is manufactured or transported. Also, when the color cathode ray tube is installed in a television set, the degradation of color purity due to miss landing of electron beams caused by the sympathetic vibration of the shadow mask with a sound generated from a speaker can be minimized, thereby further enhancing the visibility of display.

A description will now be given of a case where the color cathode ray tube of the embodiment is applied to a substantially flat color cathode ray tube in which the panel has an effective diagonal length of 60 cm and an aspect ratio of 4:3, the curvature radius of the outer surface of the effective section of the panel is 10 m, and the inner surface of the effective section has a low curvature.

In the shadow mask 6 to be jointed to a flat panel 3 having a curvature radius of 10 m at the outer surface of the effective section 1, each long side of the mask main body 15, each long side wall 14*a* of the skirt portion 14 and each long side wall 17*a* of the mask frame 17 are formed in a convex curved shape and have their respective central portions protruded outward. Each long side of the mask main body 15 and each long side wall 14*a* of the skirt portion 14 have a fall ratio of YML/LML, and each long side wall 17*a* of the mask frame 17 has a fall ratio of YFL/LFL.

Further, each short side of the mask main body 15, each short side wall 14*b* of the skirt portion 14 and each short side wall 17*b* of the mask frame 17 are formed in a convex curved shape and have their respective central portions protruded outward. Each short side of the mask main body 15 and each short side wall 14*b* of the skirt portion 14 have a fall ratio of XMS/LMS, and each short side wall 17*b* of the mask frame 17 has a fall ratio of XFS/LFS.

In this case, the above fall ratios are set as follows:

$$YML/LML = YFL/LFL = 0.022$$

$$XMS/LMS = XFS/LFS = 0.031$$

If the long and short sides of the mask main body 15 are formed in the convex curved shape as mentioned above, the mask surface 13 of the shadow mask 6 can have a high strength and hence be prevented from being deformed even if the mask surface 13 has a low curvature. Accordingly, the mask main body 15 is prevented from being deformed by an impact or a vibration applied thereto while the color cathode ray tube is manufactured or transported. Further, when the color cathode ray tube is installed in a television set, the degradation of color purity due to miss landing of electron beams caused by the sympathetic vibration of the shadow mask with a sound from a speaker can be minimized, thereby further enhancing the visibility of display.

Figure 4A:
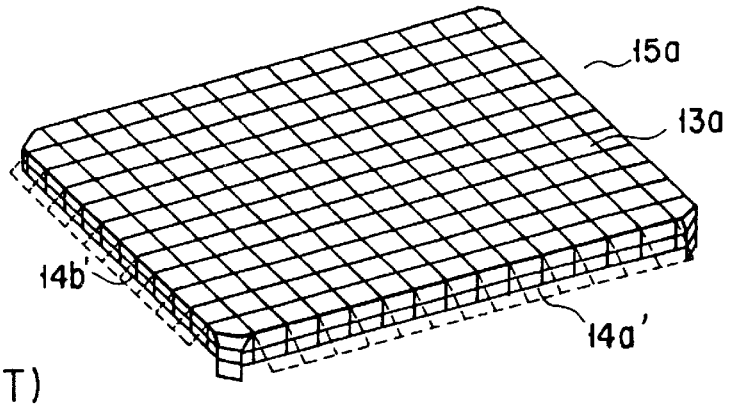
FIG. 4A (PRIOR ART)
FIG. 4A is a perspective view schematically showing a deformed state of a conventional shadow mask.

Specifically, if an impact is applied from the outside to a conventional mask main body 15*a* itself, in which the long and short side walls 14*a*' and 14*b*' have a curvature of substantially 0, i.e. a fall ratio of 0, as shown in FIG. 4A, the long and short side walls 14*a*' and 14*b*' are significantly deformed as is indicated by the broken lines, thereby greatly deforming its mask surface 13*a*.

Figure 4B:
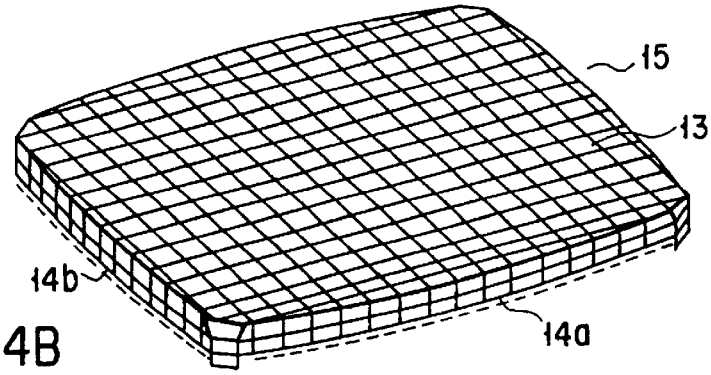
FIG. 4B is a perspective view schematically showing a deformed state of the shadow mask employed in the first embodiment.

On the other hand, in the case of the mask main body 15 of the present embodiment in which the long and short sides of the mask surface 13 and the long and short side walls 14*a* and 14*b* of the skirt portion 14 are formed in the convex curved shape having the aforementioned fall ratio, the degree of deformation of the long and short side walls 14*a* and 14*b* is reduced as indicated by the broken lines in FIG. 4B, thereby reducing the degree of deformation of the mask surface 13. As a result, the mask main body 15 is prevented from being deformed while or after the color cathode ray tube is manufactured, and the degradation of color purity due to miss landing of electron beams on the three-color phosphor layers is suppressed.

Figure 5:
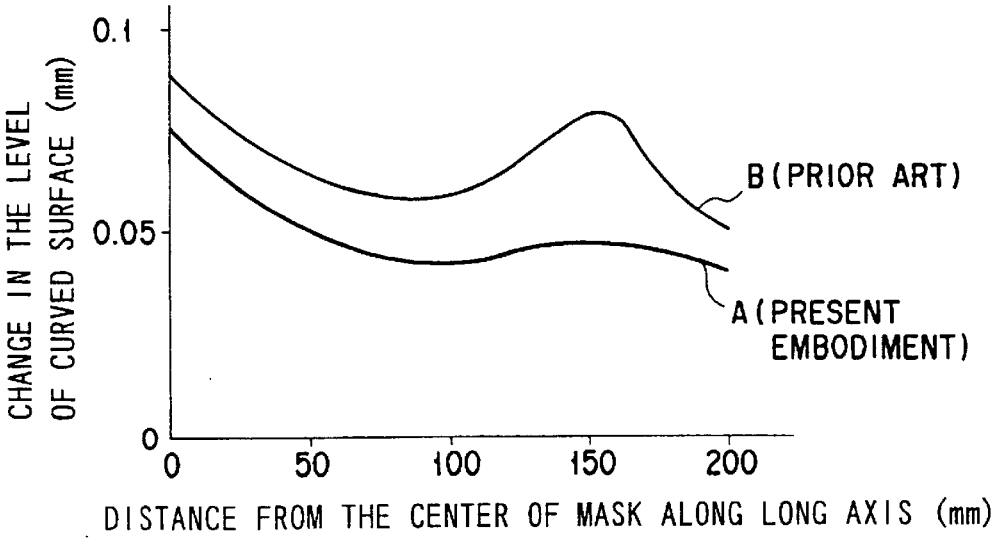
FIG. 5 is a graph illustrating the relationship between a distance from the center of the shadow mask along the long axis X and a change in the level of a mask surface, obtained when the same load is applied to the mask main body of the conventional shadow mask and the shadow mask of the embodiment.

Furthermore, if the same load is applied to the mask surface 13*a* of the conventional mask main body 15*a* and to the mask surface 13 of the mask main body 15 according to the present embodiment, the resultant amount of X-directional deformation of the mask main body of the embodiment is smaller than that of the conventional mask main body, as is evident from curve A (indicating the embodiment) and curve B (indicating the conventional case) in FIG. 5. In particular, in the embodiment, the deformation of the mask main body 15 can be remarkably reduced at an X-directional intermediate portion thereof, the deformation of which is greatest and hence at which the degradation of color purity is greatest.

Similarly, if the same load is applied to the mask surface 13*a* of the conventional mask main body 15*a* and to the mask surface 13 of the mask main body 15 of the embodiment, the resultant amount of Y-directional deformation of the mask main body of the embodiment is smaller than that of the conventional mask main body, as is evident from curve A (indicating the embodiment) and curve B (indicating the conventional case) in FIG. 6. In particular, in the embodiment, the deformation of the mask main body can be remarkably reduced at a Y-directional intermediate portion thereof, the deformation of which is greatest and hence at which the degradation of color purity is greatest.

Thus, the degradation of color purity can effectively be prevented by reducing the degree of deformation of the mask main body 15, thereby reducing the amount of deviation of an electron beam landing on the phosphor layer of the phosphor screen 5.

Further, where the mechanical strength of the mask main body 15 is enhanced, as shown in FIG. 2, the fall ratio ZPH/LPH at the X-directional end and the fall ratio ZPV/LPV at the Y-directional end of the inner surface of the effective section 1 of the panel 3 can be set at 0.026 and 0.044, respectively. In this case, the X-directional viewing angle of the panel 3 is increased. Moreover, in the peripheral portion of the panel 3, the reflection of outside light, such as light emitted from a fluorescent lamp, which is related to the Y-directional fall ratio, can be significantly reduced.

In addition, when, in the panel 3 constructed as above, the transmittance of glass forming the panel was set at 50%, the thickness of the central portion of the effective section 1 at 12.0 mm, and the thickness of a peripheral portion of the effective section at 25.0 mm, the phosphor screen 5 could have a uniform brightness from its center to its periphery with keeping a sufficient contrast, which means that a color cathode ray tube of a high-quality display could be obtained.

Examinations were executed on panels 3 of different Td/Tc ratios (Tc: the thickness of a central portion of each panel; Td: the thickness of a peripheral portion). The following table 1 indicates the examination results. From the examination results concerning the relationship between "blackness uniformity" and "brightness uniformity" in each panel (○: better, Δ: good, X: bad), it is evident that the Td/Tc ratio of each panel should preferably be set at a value less than 2.5 (Td/Tc<2.5) in order to enhance the visibility of display. Furthermore, it was found that the transmittance should be set at 40–60%.

TABLE 1

| Td/Tc | 2.00 | 2.25 | 2.50 | 2.75 |
|---|---|---|---|---|
| Blackness Uniformity | ○ | ○ | Δ | X |
| Brightness Uniformity | ○ | ○ | ○ | Δ |

Although, in the above-described embodiment, both the long and short sides of the mask main body 15 are outwardly curved, the mask surface 13 can be strengthened by curving only the long sides or the short sides of the mask main body surface 15.

FIGS. 7A to 7C illustrate a shadow mask 6 according to a second embodiment of the present invention. In the shadow mask 6 of this embodiment, the long sides of the mask surface 13 and the long side walls 14*a* of the skirt portion 14 are formed linearly and flat, and only the short sides of the mask surface 13 and the short side walls 14*b* of the skirt portion 14 are formed in a convex curved shape such that their central portions project outwardly. Similarly, the long side walls 17*a* of the mask frame 17 are formed flat, while the short side walls 17*b* are formed in a convex curve shape such that their central portions project outwardly.

The other structural elements are similar to those in the first embodiment. Therefore, they are denoted by corresponding reference numerals used in the first embodiment, and are not described in detail.

Figure 8A:
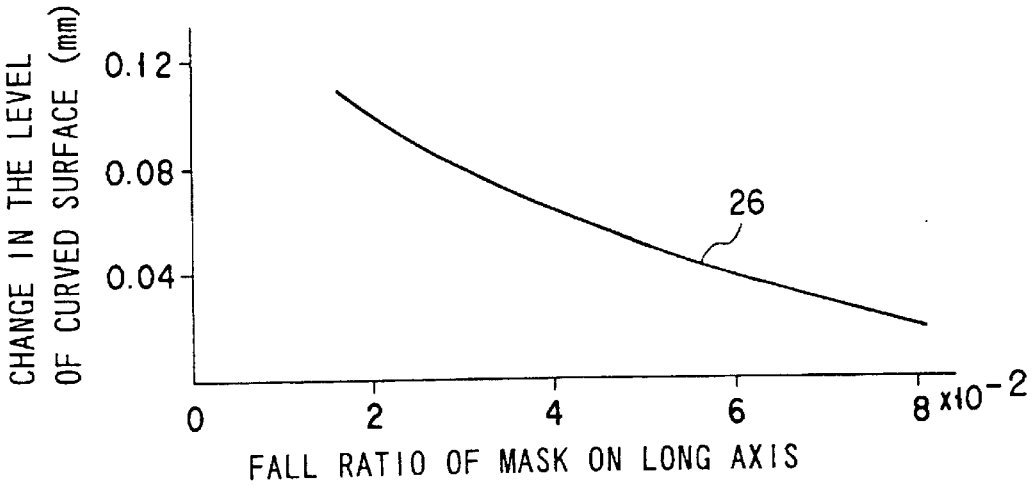
FIG. 8A is a graph showing the relationship, obtained in the second embodiment, between the fall rate of the mask surface of the mask main body on the long axis and a change in the level of the mask surface.

If, in the mask main body 15 constructed as mentioned above, the fall ratio (XMS/LMS) of the short sides of the mask surface 13 and the short side walls 14*b* of the skirt portion 14 is 0.020, curve 26 in FIG. 8A indicates the relationship between the fall ratio of the mask surface 13 on the long axis X and a change in the level of an X-directional middle portion of the mask surface 13 caused by the weight of the mask main body 15 itself. As is understood from FIG. 8A, the lower the fall ratio of the mask surface 13, the larger the deformation of the mask surface.

Figure 8B:
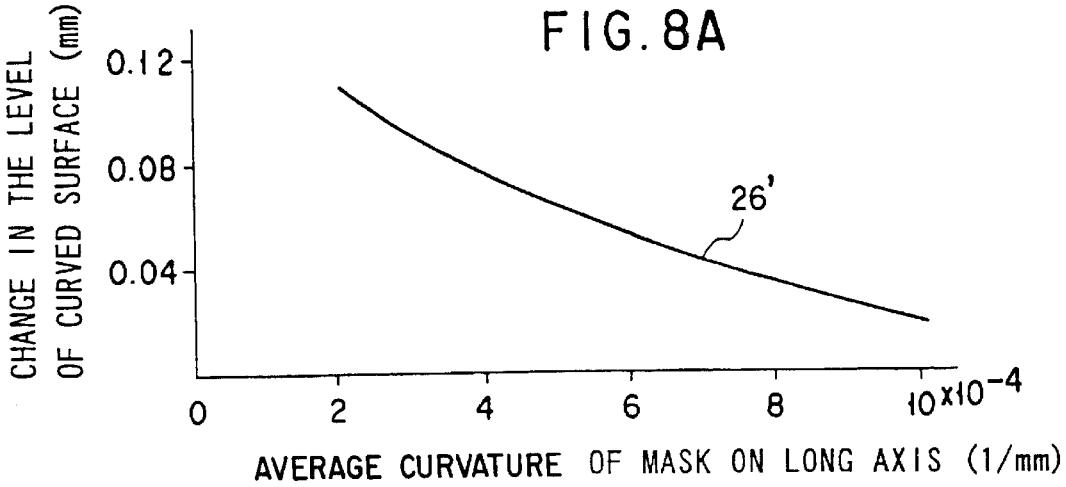
FIG. 8B is a graph showing the relationship, obtained in the second embodiment, between the curvature of the mask surface of the mask main body on the long axis and a change in the level of the mask surface.

Curve 26' in FIG. 8B shows a relationship between the average curvature of the mask surface 13 on the long axis X and a change in the level of an X-directional middle portion of the mask surface 13. This curve 26' has the substantially same characteristics as the curve 26 shown in FIG. 8A.

Figure 9:
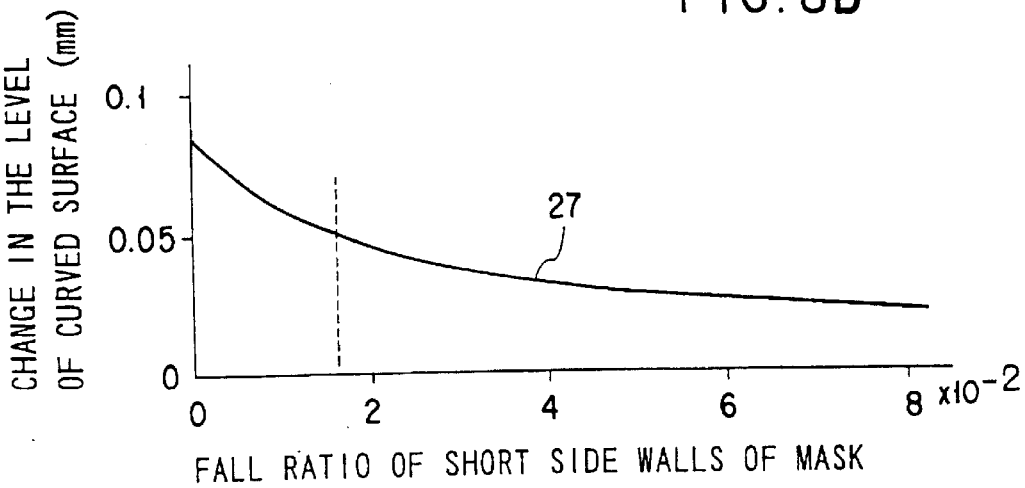
FIG. 9 is a graph showing the relationship, obtained in the second embodiment, between the fall rate of the short side walls of the mask main body and a change in the level of the mask surface.

Further, if, in the mask main body 15, the fall ratio of the mask surface 13 on the long axis X is 0.043, curve 27 in FIG. 9 indicates the relationship between the fall ratio of the short side walls 14*b* of the skirt portion 14 and a change in the level of an X-directional middle portion of the mask surface 13. As is evident from FIG. 9, when the fall ratio of the short side walls 14*b* is set at 0.015 or more, the deformation of the mask surface 13 can be suppressed, thereby effectively reducing the degradation of color purity.

Figure 10:
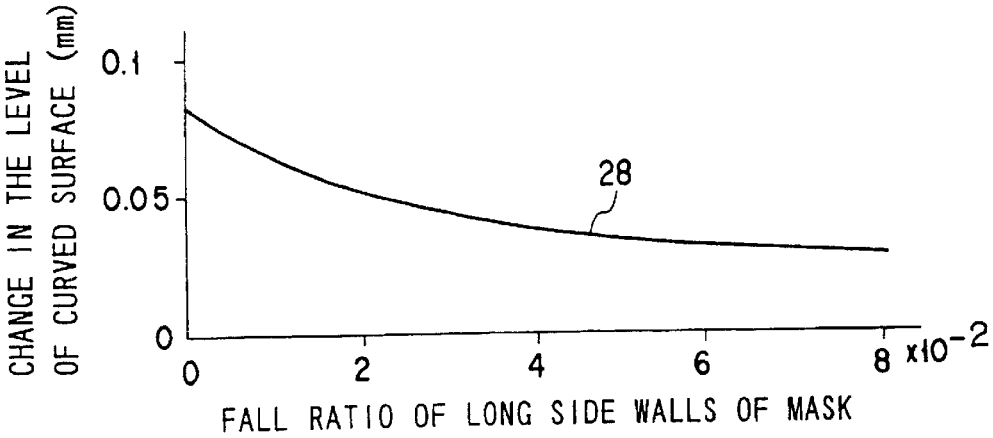
FIG. 10 is a graph showing the relationship, obtained in the second embodiment, between the fall rate of the long side walls of the mask main body and a change in the level of the mask surface.

In the shadow mask 6 employed in the second embodiment, the long sides of the mask surface 13 are formed linearly, the long side walls 14*a* of the skirt portion 14 are formed flat, and the short sides of the mask surface 13 and the short side walls 14*b* of the skirt portion 14 are formed in a convex curved shape such that their central portions project outwardly. However, this structure may be modified so that the long sides of the mask surface 13 and the long side walls 14*a* of the skirt portion 14 are formed in a convex curved shape to make their central portions project outwardly, and the short sides of the mask surface 13 and the short side walls 14*b* of the skirt portion 14 are formed linearly and flat, respectively. Also in this case, the same effect as those in the second embodiment can be obtained as indicated by curve 28 in FIG. 10, which shows the relationship between the fall ratio of the long side walls and a change in the level of a middle portion of the mask surface.

Accordingly, even where only long sides or short sides of the mask main body 15 of the shadow mask 6 are curved, the deformation of the mask surface 13 with a low curvature can be suppressed by appropriately setting the curvature. Thus, the degradation of color purity can be effectively reduced.

When the fall ratio (LPV/ZPV) of the inner surface of the effective section 1 of the panel 3 at the Y-directional end was set at 0.039 in accordance with the above-described mask main body 15, the reflection of outside light on the inner surface of the effective section 1 could be prevented from entering the eyes of the viewer.

Further, the reflection of outside light on the inner surface of the effective section 1 of the panel 3 was examined, with the distance from the screen of the television to the viewer and the horizontal and vertical distances from the center of the screen to a fluorescent lamp set at 2 m, 3 m and 1.5 m, respectively (which are considered general conditions for viewing the television). Curve 30 in FIG. 11 indicates the relationship, obtained from the examination, between the curvature of the inner surface of the effective section 1 of the panel 3 and the position of an image of the lamp reflected from the inner surface to the viewer (the Y-directional distance from the center of the screen).

Figure 11:
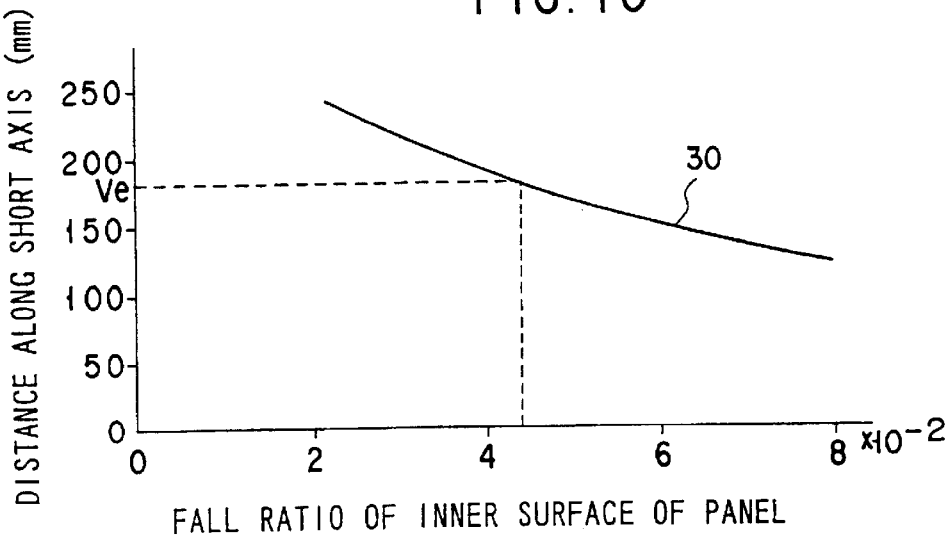
FIG. 11 is a graph showing the relationship, obtained in the second embodiment, between the fall rate of the inner surface of the effective section of the panel and a reflection image of a fluorescent lamp on a screen.
Figure 12:
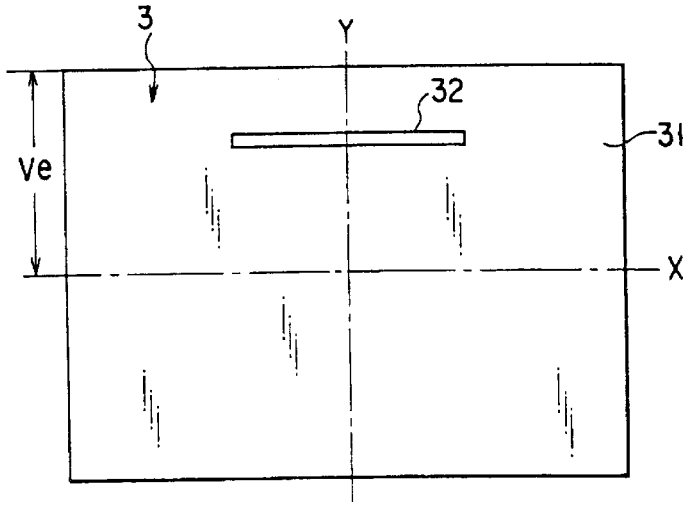
FIG. 12 a schematic view illustrating a reflection image of the fluorescent lamp on the screen.

As is understood from FIG. 11, even if the inner surface of the effective section 1 of the panel 3 has a curvature, a reflection image 32 of the lamp on a screen 31 shown in FIG. 12 does not enter the eyes of the viewer or only slightly enters them, when the fall ratio is about 0.044 or less. This is because the reflection image 32 is situated outside the Y-directional effective length Ve of the screen.

Although the conditions for preventing the relection of outside light from entering the eyes of the viewer are further enhanced if the effective length of the screen is larger, the fatigue of the eyes due to the reflection of outside light is significantly reduced if the inner surface of the effective section 1 of the panel 3 has a low curvature and a fall ratio of about 0.044 or less.

Further, although, in the first and second embodiments, the mask frame 17 of the shadow mask 6 has a shape corresponding to the skirt portion 14*b* of the mask main body 15, the long side walls 17*a* and the short side walls 17*b* of the mask frame 17 may be formed flat.

Figure 13A:
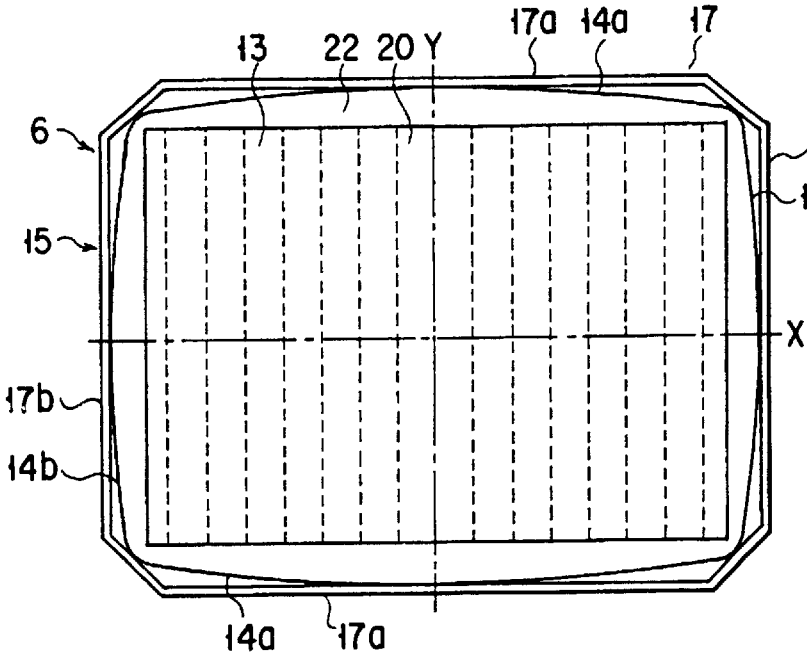
FIG. 13A is a plan view illustrating a shadow mask employed in a color cathode ray tube according to a third embodiment.
Figure 13C:
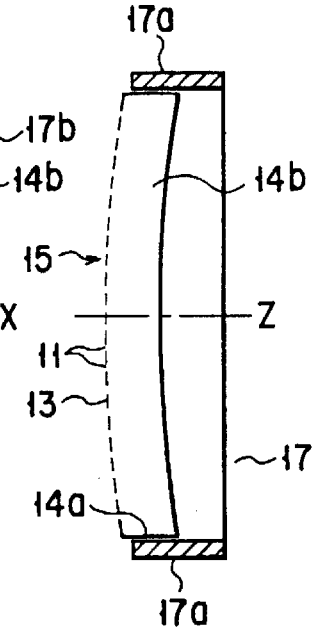
FIG. 13C is a sectional view taking along the short axis Y of the shadow mask.
Figure 13B:
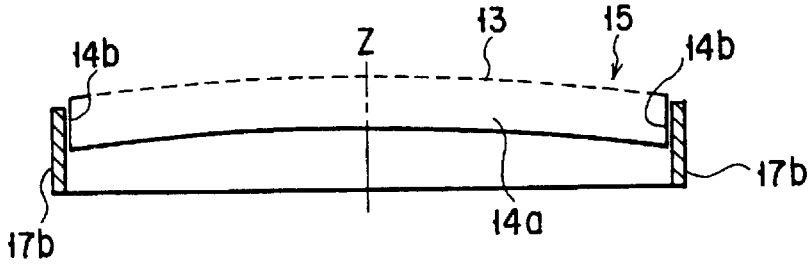
FIG. 13B is a sectional view taking along the long axis X of the shadow mask.

Referring now to FIGS. 13A to 13C, a shadow mask 6 according to a third embodiment will be described. In the shadow mask 6 of the third embodiment, the long and short sides of the mask surface 13, and the long and short side walls 14*a* and 14*b* of the skirt portion 14 have a convex curved shape such that their central portions project outwardly. On the other hand, the long and short side walls 17*a* and 17*b* of the mask frame 17 are formed linearly. The mask main body 15 is fixed to the mask frame 17 at central portions of the long and short side walls 14*a* and 14*b* of the skirt portion 14 and at the corners of the skirt portion 14.

The other structural elements are similar to those in the first embodiment. Therefore, they are denoted by corresponding reference numerals used in the first embodiment, and are not described in detail.

The shadow mask 6 according to the third embodiment can also provide the aforementioned advantages by curving long and/or short sides of the mask main body 15 such that their central portions project outwardly and the sides have a fall ratio of 0.044 or less. Therefore, a deformation of the curvature of the mask surface 13 can be suppressed, thereby effectively reducing the degradation of color purity.

In recent years, many shadow masks are available in which their mask frames are formed thinner for reducing the weight of the shadow masks, and elastic frame support members are attached near the corners of the mask frame for compensating a reduction in the mechanical strength of the mask frames resulting from the thickness reduction. If the structure of the shadow mask 6 of the above-mentioned embodiment is employed in the above-shadow masks, a significant advantage can be obtained. When an impact of about 10G was applied to a mask frame 17 of 0.5 mm thick, the deformation of the mask frame could be reduced by about 20%.

INDUSTRIAL APPLICABILITY

As described above, the present invention provides a color cathode ray tube of a high display visibility, in which the curvature of the outer surface of the effective section of the panel is minimized to make the outer surface almost flat, thereby reducing the curvature of the effective section of the mask main body, at the same time, minimizing the deformation of the mask main body due to an impact or vibration applied thereto during its manufacture or transport, minimizing resonance between a sound emitted from a speaker and the mask main body when it is installed in a television set, and reducing the degradation of color purity due to erroneous miss landing of electron beams.

What is claimed is:

1. A color cathode ray tube comprising:

a vacuum envelope including a substantially rectangular panel having a substantially flat outer surface, an inner surface provided with a phosphor screen, and a long axis and a short axis perpendicular to each other and also to a tube axis;

a shadow mask arranged in the vacuum envelope and opposed to the phosphor screen, the shadow mask including a mask main body that has a substantially rectangular mask surface and a skirt portion extending along a periphery of the mask surface, and a substantially rectangular mask frame attached to the skirt section of the mask main body, the mask surface including an effective portion opposed to the phosphor screen and provided with a plurality of electron beam passage apertures; and an electron gun provided in the vacuum envelope for emitting electron beams onto the phosphor screen through the shadow mask, wherein:

the inner surface of the panel has an effective section with a curvature, the inner surface of the panel being formed to satisfy at least one of the following relationships:

$$ZPH/LPH \leqq 0.050,$$

and $$ZPV/LPV \leqq 0.050$$

where LPH represents a distance from a center of the effective section to a long axis end of the effective section, LPV represents a distance from the center of the effective section to a short axis end of the effective section, ZPH represents a fall of the effective section at the long axis end along the tube axis with respect to a level of the center of the effective section, and ZPV presents a fall of the effective section at the short axis end along the tube axis with respect to the level of the center of the effective section; and the mask surface has a pair of long sides situated symmetrical with respect to the long axis, and a pair of short sides situated symmetrical with respect to the short axis, at least one of each long side and each short side being curved such that a central portion thereof projects outwardly, and satisfying at least corresponding one of the following relationships:

$$YML/LML \leqq 0.015,$$

and $$XMS/LMS \leqq 0.015$$

where LML represents a distance from the short axis of the effective portion of the mask surface to each corner of the effective portion, LMS represents a distance from the long axis of the effective portion of the mask surface to each corner of the effective portion, YML represents a fall, along the short axis, between a point of each long side of the mask surface on the short axis and a point of said each long side which is apart from the short axis by LML, and XMS represents a fall, along the long axis, between a point of each short side of the mask surface on the long axis and a point of said each short side which is apart from the long axis by LMS.

2. The color cathode ray tube according to claim 1, wherein the panel has a transmittance of 40 to 60% at the center of the effective section, and is formed to satisfy Td/Tc<2.5 where Tc represents a thickness of the center of the effective section, and Td represents a thickness of the panel at an effective length end of the phosphor screen.

3. The color cathode ray tube according to claim 1, wherein the mask frame has a pair of long side walls situated symmetrical with respect to the long axis, and a pair of short side walls situated symmetrical with respect to the short axis, at least one of each long side wall and each short side wall having a convex curved shape such that a central portion thereof projects outwardly, and satisfying at least corresponding one of the following relationships:

$$YFL/LFL \leqq 0.015,$$

and $$XFS/LFS \leqq 0.015$$

where LFL represents a distance from the short axis of the effective section of the mask surface to each corner of the effective section, LFS represents a distance from the long axis of the effective section of the mask surface to each corner of the effective section, YFL represents a fall, along the short axis, between a point of each long side wall of the mask frame on the short axis and a point of said each long side wall which is apart from the short axis by LFL, and XFS represents a fall, along the long axis, between a point of each short side wall of the mask frame on the long axis and a point of said each short side wall which is apart from the long axis by LFS.

4. A color cathode ray tube comprising:

a vacuum envelope including a substantially rectangular panel having a substantially flat outer surface, an inner surface provided with a phosphor screen, and a long axis and a short axis perpendicular to each other and also to a tube axis;

a shadow mask arranged in the vacuum envelope and opposed to the phosphor screen, the shadow mask including a mask main body that has a substantially rectangular mask surface and a skirt portion extending along a periphery of the mask surface, and a substantially rectangular mask frame attached to the skirt section of the mask main body, the mask surface including an effective portion opposed to the phosphor screen and provided with a plurality of electron beam passage apertures; and an electron gun provided in the vacuum envelope for emitting electron beams onto the phosphor screen through the shadow mask, wherein:

the inner surface of the panel has an effective section with a curvature, the inner surface of the panel being formed to satisfy at least one of the following relationships:

$$ZPH/LPH \leqq 0.050,$$

and $$ZPV/LPV \leqq 0.050$$

where LPH represents a distance from a center of the effective section to a long axis end of the effective section, LPV represents a distance from the center of the effective section to a short axis end of the effective section, ZPH represents a fall of the effective section at the long axis end along the tube axis with respect to a level of the center of the effective section, and ZPV presents a fall of the effective section at the short axis end along the tube axis with respect to the level of the center of the effective section; and the mask frame has a pair of long side walls situated symmetrical with respect to the long axis, and a pair of short side walls situated symmetrical with respect to the short axis, at least one of each long side wall and each short side wall having a convex curved shape such that a central portion thereof projects outwardly, and satisfying at least corresponding one of the following relationships:

$$YFL/LFL \leqq 0.015,$$

and $$XFS/LFS \leqq 0.015$$

where LFL represents a distance from the short axis of the effective section of the mask surface to each corner of the effective section, LFS represents a distance from the long axis of the effective section of the mask surface to each corner of the effective section, YFL represents a fall, along the short axis, between a point of each long side wall of the mask frame on the short axis and a point of said each long side wall which is apart from the short axis by LFL, and XFS represents a fall, along the long axis, between a point of each short side wall of the mask frame on the long axis and a point of said each short side wall which is apart from the long axis by LFS.

5. The color cathode ray tube according to claim 4, wherein the panel has a transmittance of 40 to 60% at the center of the effective section, and is formed to satisfy Td/Tc<2.5 where Tc represents a thickness of the center of the effective section, and Td represents a thickness of the panel at an effective length end of the phosphor screen.

* * * * *